US010865816B2

(12) United States Patent
Kopp et al.

(10) Patent No.: US 10,865,816 B2
(45) Date of Patent: Dec. 15, 2020

(54) LINEAR DRIVE DEVICE

(71) Applicant: FESTO SE & CO. KG, Esslingen (DE)

(72) Inventors: Simone Kopp, Esslingen (DE); Ulrich Diener, Esslingen (DE); Dominik Nowak, Remshalden (DE); Philipp Ruthardt, Esslingen (DE); Philip Naumann, Ebersbach (DE); Jörg Bitzer, Esslingen (DE)

(73) Assignee: FESTO SE & CO. KG, Esslingen (DE)

( * ) Notice: Subject to any disclaimer, the term of this patent is extended or adjusted under 35 U.S.C. 154(b) by 0 days.

(21) Appl. No.: 16/404,420

(22) Filed: May 6, 2019

(65) Prior Publication Data

US 2019/0360507 A1 Nov. 28, 2019

(30) Foreign Application Priority Data

Mar. 14, 2018 (DE) ..... 10 2018 002054

(51) Int. Cl.

| | |
|---|---|
| ***F15B 15/24*** | (2006.01) |
| ***F15B 15/14*** | (2006.01) |
| ***F15B 15/22*** | (2006.01) |
| ***F15B 15/28*** | (2006.01) |
| *F15B 15/08* | (2006.01) |

(52) U.S. Cl.

CPC ..... *F15B 15/24* (2013.01); *F15B 15/14* (2013.01); *F15B 15/1471* (2013.01); *F15B 15/22* (2013.01); *F15B 15/2807* (2013.01); *F15B 15/082* (2013.01)

(58) Field of Classification Search

CPC .... F15B 15/082; F15B 15/084; F15B 15/086; F15B 15/228; F15B 15/24; F15B 15/2807

See application file for complete search history.

(56) References Cited

U.S. PATENT DOCUMENTS 5,335,583 A * 8/1994 Kaneko ..... F15B 15/24 92/13.5
5,511,461 A * 4/1996 Miyachi ..... B23Q 11/08 92/13.5

(Continued)

FOREIGN PATENT DOCUMENTS

| | | |
|---|---|---|
| DE | 10 2005 015 216 B4 | 2/2007 |
| DE | 10 2010 056 367 A1 | 7/2011 |
| EP | 0 868 965 B1 | 12/2001 |

*Primary Examiner* — Michael Leslie
(74) *Attorney, Agent, or Firm* — Birch, Stewart, Kolasch & Birch, LLP

(57) ABSTRACT

The invention relates to a linear drive device having a housing element in which at least one drivable actuating element is arranged, a guide unit which is coupled to the actuation element and moves relative to the housing element between two stroke end positions in linear direction, a stroke limiting device, by means of which a first stroke end position and a second stroke end position of the guide unit are adjustable, wherein the stroke limiting device has a first stop and a first counterstop for setting a limit of the first stroke end position and a second stop and a second counterstop for setting a first limit of the second stroke end position, wherein the stroke limiting device has a third stop which is adapted to set a second limit of the second stroke end position adjusted with the first counterstop.

19 Claims, 6 Drawing Sheets

(56) References Cited

U.S. PATENT DOCUMENTS

| | | | | |
|---|---|---|---|---|
| 5,653,314 | A * | 8/1997 | Yamamoto | F15B 15/082 188/67 |
| 5,884,549 | A * | 3/1999 | Hosono | B23Q 1/58 92/5 R |
| 5,950,790 | A * | 9/1999 | Barber | F15B 15/082 192/139 |
| 6,014,924 | A | 1/2000 | Stoll et al. | |
| 6,338,294 | B1 * | 1/2002 | Wagner | F15B 15/082 92/88 |
| 6,874,407 | B2 * | 4/2005 | Doleschel | F15B 15/082 92/88 |
| 7,225,722 | B2 * | 6/2007 | Angue | F15B 15/1414 92/165 R |
| 7,290,478 | B2 * | 11/2007 | Williams | F16C 29/00 92/88 |

* cited by examiner

LINEAR DRIVE DEVICE

TECHNICAL FIELD

The invention relates to a linear drive device with a housing element, in which at least one drivable actuating element is arranged. The linear drive device comprises a guide unit, which is motion-coupled to the actuating element and is guided linearly movable relative to the housing element between two stroke end positions. Furthermore, the linear drive device comprises a stroke limiting device, by means of which a first stroke end position and a second stroke end position of the guide unit are adjustable, wherein the stroke limiting device comprises a first stop and a first counterstop for setting a limit of the first stroke end position and a second stop and a second counterstop for setting a first limitation of the second stroke end position.

PRIOR ART

The document EP 0 868 965 B1 discloses a carriage drive device which has a basic housing in which at least one actuating element which can be driven for a linear movement is arranged. Outside on the base housing is a carriage which is motion-coupled with the actuating element. Two stroke limiting devices allow a variable specification of the two end positions of the carriage and each comprise an adjustable stop arranged on one part and a counterstop arranged opposite this on the other part. One adjustable stop is arranged on the carriage and the other adjustable stop is located on the base housing. Both stops are provided on the same endportions of the carriage or the basic housing pointing in the same axial direction.

Document DE 10 2010 056 367 A1 discloses a linear actuating element in which, by supplying a pressurized fluid from fluid inlet/outlet ports, a slide table is reciprocated along an axial direction of a cylinder main body. The linear actuating element includes the cylinder main body communicating with the inlet/outlet ports and having a pair of cylinder chambers into which the pressurized fluid is introduced, the slide table reciprocating along the axial direction of the cylinder main body, a cylinder mechanism having a pair of pistons which can slide along the cylinder chambers, the slide table being displaced by the displacement of the piston, a guide mechanism for guiding the slide table along the axial direction of the cylinder main body, the guide mechanism being attached to the cylinder main body and having a flat guide block, inside which circulation passages are formed through which a plurality of rolling elements rolls and circulates, and a stopper mechanism which is arranged at one end of the slide table centrally in the width direction perpendicular to an axial direction of the slide table to the back, in order to regulate the reciprocating movement of the slide table, wherein the stopper mechanism is displaced together with the slide table and abuts an end of the slide block.

The document DE 10 2005 015 216 B4 discloses a damping device for linear drives, with damping means which are arranged axially adjustable outside the linear drive, which are in operative connection with at least one stroke stop of the linear drive which is also arranged outside. The damping stroke takes place via the damped retraction of a piston rod, wherein the damping stroke takes place due to a pneumatic damping, and the return stroke via a rod magnet integrated frontally in the piston, which is magnetically frictionally held on the stop of the linear drive and moved along.

A problem in the prior art is the fact that the setting or the adjustment of stroke limiting devices or damping means directly depend on the specific arrangement of the respective stroke limiting device or the damping means. In other words, as a rule, the stroke limiting devices must be changed from exactly that side of the linear drive device on which they are arranged. Consequently, a user of such linear drive devices must make the selection of a concrete linear drive device contingent on the purpose and above all of spatial conditions. If the spatial limiting conditions require, for example, that both stroke end positions of the linear drive device must be adjusted from one front side of the linear drive, then both stops of the stroke limiting device must be arranged on this front side. This considerably limits the intended use of each linear drive. Once a user has opted for a specific arrangement of a linear drive, the access to the stroke limiting device cannot be varied.

The object of the invention is to provide a linear drive device belonging to the technical field mentioned above, which overcomes the disadvantages of the prior art and allows a linear drive device with increased flexibility for the customer. Furthermore, it is the object of the invention to provide a linear drive, which has a stroke limiting device whose adjustability is possible from one or two front sides of the linear drive device depending on what is required by the customer.

The solution of the problem is defined by the features of claim 1. According to the invention, the stroke limiting device has a third stop which is adapted to set a second limit of the second stroke end position with the first counterstop.

By arranging a third stop, which is adapted to limit a second limit of the second stroke end position with the first counterstop, a user of the linear drive device can choose from which front side of the linear drive he wants to set the second stroke end position. He can thus adjust the second stroke end position from the same front side, from which also the first stroke end position is adjustable. This may be of particular importance for example for sites with limited spatial conditions. Alternatively, it is possible to adjust the second stroke end position from that front side of the linear drive device, which is opposite to the front side for adjusting the first stroke end position. Another advantage results with respect to the production of a linear drive device according to the invention. There is no longer the need to produce different components of the linear drive device for every possible customer requirement. Instead, it is possible to produce a smaller number of variants, which can be a standardization of individual components and thereby achieve improved cost efficiency.

Linear drive devices can be used as piston-cylinder units with and without a piston rod. The force generated by the driving pressure means on the piston is transferred via the piston rod or an alternative driver performing the same function on a guide unit in the form of a carriage of the linear drive device. The guide unit is movable along a housing. However, possible linear drive devices of the present type are also linear drive devices with an alternative drive energy, such as in particular hydraulically or electromagnetically driven linear actuating elements. To limit the procedure of the guide unit, stroke limiting means such as stops or damping devices are typically used. Such stroke limiting means also serve to change or adjust the stroke of the guide unit.

A housing element usually forms the receptacle for a piston-piston rod unit. The driving pressure medium is introduced via defined connections in the housing element and drives the piston-piston rod unit. Since the housing element usually has a greater mass than all other components of a linear drive device, the housing element is usually used as a stationary component.

An actuating element usually comprises the piston-piston rod unit, which is moved by the driving pressure means in the housing element. The piston can be driven both electrically and fluidically, in particular hydraulically or pneumatically.

The guide unit is slidably disposed between two stroke end positions on the housing member and connected to the connecting element. This connecting element allows the transmission of the moving element on the guide unit. In most cases, the guide unit is formed like a carriage and offers versatile connection possibilities in the operation of the linear drive device.

A stroke limiting device may consist of a variety of means which are suitable at least to determine or even set the two stroke end positions. The stroke limiting device may comprise individual components which interact with both the housing element and the guide unit. Alternatively, the stroke limiting device can also be integrated into the guide unit and the housing element. This can usually be achieved by means of stops and corresponding counterstops, which meet upon reaching a certain stroke end position and thus block further movement in the stroke end position.

In order to additionally increase the flexibility of the linear drive device, the stroke limiting device has a fourth stop which is adapted to set a second limit of the first stroke end position with the second counterstop. A user can thus unrestrictedly decide from which end side he would like to adjust which stroke end position. For each individual stroke end position, therefore, both the first and the second front side of the linear drive device can be selected. Also, the production costs are significantly reduced, since only a smaller number of variants must be produced. As a result, a standardization of individual components and thereby improved cost efficiency can be achieved.

According to an advantageous embodiment, at least the first stop, the second counterstop and the third stop are fixedly connected to the housing element. This reduces both the manufacturing costs and the assembly costs of the linear drive device.

An additional optimization of the manufacturing costs and the assembly costs is achieved in connection with the linear drive device in that at least the first stop, the second stop and the third stop is formed with the housing element as an integral component. This results in, for example, the advantage that the integral design of the housing element reduces both the manufacturing costs and the installation effort of the linear drive device. In addition, the actually moving mass of the linear drive device is reduced and less energy must be introduced into the movement of the guide unit. Furthermore, the accuracy and strength of the linear drive device are improved.

In order to be able to adapt the linear drive device as flexibly as possible to customer requirements, the first counterstop or the second counterstop is adapted for arranging a damping element. Also, the first counterstop and the second counterstop can be adapted for arranging a damping element.

In order to reduce the number of components of the linear drive device and the assembly costs for the linear drive device, the first counterstop and the second counterstop are formed fixedly connected to the guide unit. Additional optimization of the manufacturing costs and the assembly costs experienced by the linear drive device, characterized in that the first counterstop and the second counterstop are formed with the guide unit as an integral component.

According to a further advantageous embodiment, at least the first stop, the second stop and the third stop are adapted each for arranging a damping element. As a result, in particular, the technical advantage is realized that the property of all three stops, each to be able to support a damping element, does not necessarily mean that all stops of the linear drive device bear such a damping element. Instead, a user of the linear drive device can only choose two stops of the linear drive device, which he wants to use to limit the stroke end positions. By equipping only two stops with damping elements, a user thus selects the correspondingly assigned front side of the linear drive device for adjusting the respective damping element and thus the limitation of the respective stroke end position.

According to a further embodiment, each stop as well as each counterstop of the linear drive device are adapted to bear a damping element. This achieves a maximum degree of flexibility with regard to the adaptation of the linear drive device to a specific purpose. In addition, it is conceivable that a stop and a corresponding interacting counterstop could each bear a damping element. As a consequence, both damping elements come into direct contact to limit a stroke end position.

In a particular additional embodiment, the fourth stop is adapted for arranging a damping element. This additionally increases the flexibility with respect to the placement and adjustment of damping elements.

In order to adapt the linear drive device even more flexible to a customer benefit, each damping element is adjustable designed to set a stroke end position. By an adjustable damping element, the technical advantage is achieved that the stroke end positions of the linear drive device can be slowed down gently by means of the damping element. In addition, the adjustment of a damping element has the advantage that a simple adjustment or adaptation of the damping element in the respective stroke end position is possible. This relates on the one hand to the geometric change in the stroke end position and on the other hand to the change in the damping parameters of a damping element itself. For example, the adjustment can be done with a socket wrench, with a screwdriver or other suitable tools.

According to a further preferred embodiment, the guide unit and the actuating element are connected via a connecting element. By the connecting element, a frictional connection between the actuating element and guide unit is produced. On the one hand, this makes it possible for the force generated within the housing element, which acts on the actuating element, to be transmitted directly to the guide unit via the connecting element. For example, the actuating element can be realized by a piston which is located within a pneumatic cylinder. By a piston rod, the movement caused by compressed air is transferred via the connecting element to the guide unit.

In order to allow more flexibility in the operation of the linear drive device, the connecting element is arranged front side on the linear drive device. Preferably, the connecting element is designed as a yoke plate. This results in additional advantages in terms of interfaces and connections in operation. For example, the connecting element may have additional grooves, threads or other possible connections.

In order to additionally reduce the number of components and the mounting effort for the linear drive device, the connecting element and the guide unit may be formed as an integral component. In addition, this entails the technical advantage that the integral design entails an increased rigidity of the guide unit. The increased rigidity can improve the accuracy and reduce the wear on the actuating element and the entire linear drive device.

According to a particularly preferred embodiment, the connecting element comprises at least one opening for adjusting a damping element. As a result, for example, the technical advantage is achieved that a front-side adjustability of a damping element is also possible through the connecting element. For example, a socket wrench or a screwdriver can be inserted into the opening.

In order to additionally increase the flexibility of the use of the linear drive device, the connecting element is adapted for arranging a damping element. As a result, the connecting element serves as a stop, which cooperates with the first counterstop or the second counterstop.

In order to realize a precise position determination of the guide unit in relation to the housing element, the first counterstop is adapted to support a magnetic element. Preferably, the magnetic element is completely disposed within the first counterstop. As a result, it is not necessary to arrange the magnetic element laterally on the linear drive device. Consequently, further tools are saved and the positioning of the magnetic element is particularly precise. By being placed completely within the first counterstop the magnetic element is additionally protected against external influences and damage.

In order to enable the position determination, the magnetic element must be detected by means of a sensor. The fastening of the sensor to the linear drive device takes place, for example, by means of a sensor strip. In order to fasten a sensor strip to the linear drive device, the housing element comprises at least one groove for receiving a sensor strip. Alternatively, the sensor strip can also be fastened by means of a thread on the housing element and a corresponding screw connection. For example, such a groove may be formed as a T-slot. If necessary, more than just one groove—preferably two T-slots—can be arranged on the linear drive device. In order to enable detection of the reaching of the first stroke end position and of the second stroke end position, the linear drive device has a sensor strip which has sensor elements for detecting at least the first stroke end position and the second stroke end position of the guide unit. In addition, the sensor strip can also be used to receive further sensor elements. Additional sensor elements have the advantage that the position determination of the guide unit is not limited only to the stroke end positions. In addition, intermediate positions of the guide unit can be determined.

In order to optimize the space requirement of the linear drive device, the housing element and the guide unit define a construction space through the first stroke end position and the second stroke end position, the stroke limiting device being arranged completely within the construction space. This makes it possible for a user to arrange a first linear drive device in operation immediately adjacent to a second linear drive device, without resulting in mutual restrictions due to the adjustment of stroke end positions. The space requirement is thereby minimized, whereby the complete functionality is not limited. Thus, a larger number of linear drive units can be accommodated within a predetermined space.

From the following detailed description and the totality of the claims, further advantageous embodiments and feature combinations of the invention result.

BRIEF DESCRIPTION OF THE DRAWINGS

The drawings used to explain the embodiment show:

Basically, the same parts are provided with the same reference numerals in the figures.

FIG. 1 shows a perspective view of a linear drive device 100 according to one embodiment. The linear drive device 100 comprises a housing element 200 in which two drivable actuating elements 202 in the form of pneumatic pistons are arranged. On the housing element 200 is a carriage-like guide unit 300, which is coupled for movement with the actuating element 202 and is linearly movably guided relative to the housing element 200 between two stroke end positions. On the upper side of the guide unit 300, a plurality of openings are arranged, which can be customized according to the requirements of the individual customer. In addition, the linear drive device 100 includes a stroke limiting device 400, which is located between the guide unit 300 and the housing member 200. The stroke limiting device 400 is configured to set a first stroke end position and a second stroke end position of the guide unit 300. The stroke limiting device 400 comprises a first stop 402 and a first counterstop 302. When the first stop 402 meets the first counterstop 302, the first stroke end position is limited. Furthermore, the stroke limiting device 400 comprises a second stop 404 and a second counterstop 304. The collision of the second stop 404 and the second counterstop 304 limits the second stroke end position. In addition, the stroke limiting device 400 includes a third stop 406. The third stop 406 and the first stop 402 define therebetween a distance within which the first counterstop 302 can move between two stroke end positions. Thus, the third stop 406 is adapted to set a second limit of the second stroke end position with the first counterstop 302. In other words, the coincidence of the second stop 404 with the second counterstop 304 as well as the coincidence of the first counterstop 302 with the third stop 406 can be used to set the second stroke end position.

Figure 1:
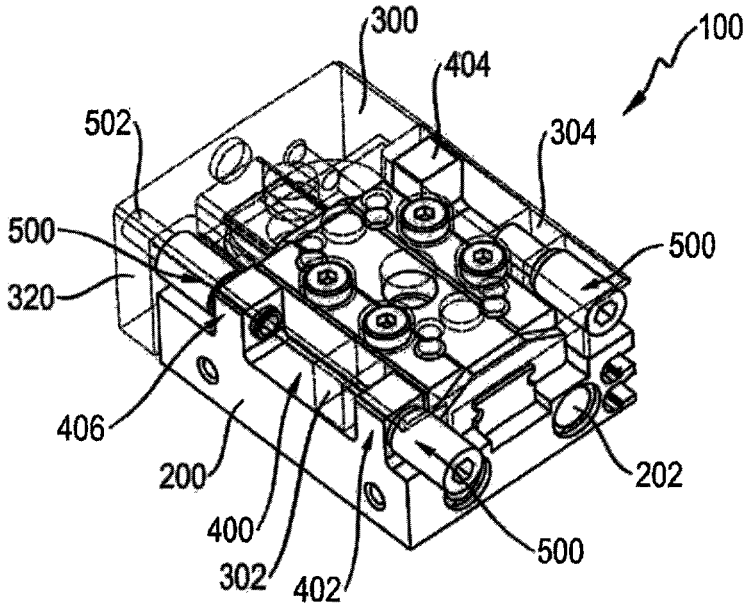
FIG. 1 is a perspective view of a linear drive device according to an embodiment.

Both the first stop 402, the second counterstop 304 and also the third stop 406 are designed to carry a respective damping element 500. Unlike the first stop 402 and the third stop 406, the second counterstop 304 is not connected to the housing element 200, but is rather designed as a movable stop on the guide unit 300. The placement of a damping element 500 brings advantages with respect to the adjustability of the stroke end position. By way of adaptation of a damping element 500, adjustment of the respective stroke end position can be achieved in a particularly simple manner. In conjunction with the aforementioned adjustment of the second stroke end position, this means that a user of the linear drive device 100 can select the side of the access to the adjustment to the linear drive device 100 via the arrangement of the damping elements 500 on the corresponding stops. Using the example of the second stroke end position, this means that, on the one hand, there is the possibility of the second stroke end position by arrangement of a damping element 500 on the second counterstop 304 or on the third stop 406. As a consequence, an adaptation or an adjustment of the second stroke end position—by adjustment of the damping element 500—must take place from a front side of the linear drive device 100, which is arranged opposite the connecting element 320. On the other hand, it is possible to realize the second stroke end position by arranging the damping element on the third stop 406. As a consequence, an adaptation of the second stroke end position must take place from one front side of the connecting element 320. The adjustability of a stroke end position by a damping element 500 must in each case be set up so that the stroke end position is reached before a collision of the second limiting on the opposite side takes place. This inevitably reduces the total distance, but this loss is on the one hand small and on the other hand this is already to be considered in the construction of the linear drive device 100.

In order to allow access by the connecting element 320 to the damping element 500 at the third stop 406, the connecting element 320 comprises an opening 502 for adjusting a damping element 500. In this case, the opening 502 is aligned exactly with the damping element 500, so that the damping element 500 can be adjusted, for example, by means of a socket wrench or a screwdriver.

The connecting element 320 is preferably designed as a yoke plate and is located at least partially on a front side of the linear drive device 100. Preferably, the connecting element 320 is formed together with the guide unit 300 as an integral component. This increases the stability and accuracy of the entire device and also reduces assembly costs.

Both the first stop 402, the second stop 404 and the third stop 406 are formed together with the housing member 200 as an integral component. For example, such a housing element 200 can be milled with all stops from a full aluminum piece. Similarly, the guide unit 300 can be manufactured by being molded together with the second counterstop 304 and the first counterstop 302 as an integral component. Similar advantages can also be achieved in the production of the connecting element 320 in that the guide unit 300 and the connecting element 320 are formed as an integral component. Thus, a total of as many assembly steps are saved and the service life of the entire linear drive device 100 can be increased with increased precision.

Laterally, a groove 204 is disposed on the housing member 200. It runs parallel to the direction of movement of the guide unit 300 and is designed in particular for arranging a sensor strip 600 (not shown). Alternatively, the arrangement of a fastening thread is also suitable here.

Figure 2A:
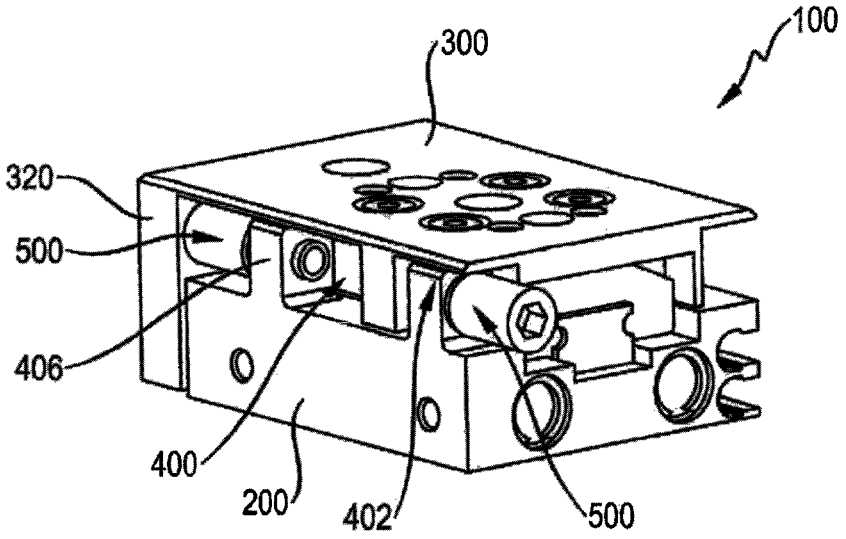
FIG. 2A is a perspective view of a linear drive device according to another embodiment.

FIG. 2A shows a perspective view of a linear drive device 100 according to a further embodiment. This embodiment has a damping element 500 on the first stop 402 and on the third stop 406. Consequently, the first stroke end position and the second stroke end position are adjustable by the damping elements 500 on the first stop 402 and on the third stop 406. The adjustment of the two stroke end positions takes place in each case by adjusting the corresponding damping element 500 from the connecting element-side front side and the opposite front side of the linear drive device 100. A repeated description of identical features of the preceding figure will be omitted.

Figure 2B:
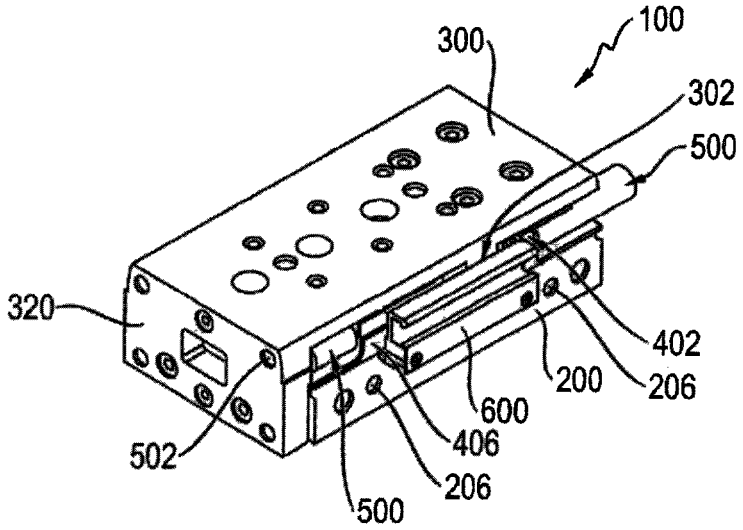
FIG. 2B is a perspective view of a linear drive device according to yet another embodiment.

FIG. 2B shows a perspective view of a linear drive device 100 according to yet another embodiment. The linear drive device 100 also comprises two damping elements 500, which are arranged on the first stop 402 and on the third stop 406. Consequently, in this embodiment as well, the first stroke end position and the second stroke end position are adjustable by the damping elements 500 on the first stop 402 and on the third stop 406. The setting of the stroke end positions takes place in each case by adjusting the corresponding damping element 500 from the connecting element-side front side and the opposite front side of the linear drive device 100.

In addition, the linear drive device 100 has a laterally arranged sensor strip 600. The sensor strip 600 may have at least one sensor element for determining the position of the guide unit 300. For example, two sensor elements are preferably arranged in the sensor strip 600 in order to determine at least the first stroke end position and the second stroke end position of the guide unit 300. In addition, the housing element 200 laterally has two threads 206, which can be used as an alternative attachment of the sensor strip 600. In order to detect the position of the guide unit 300, a magnetic member 306 (not shown) needs to be provided on the guide unit 300.

Figure 2C:
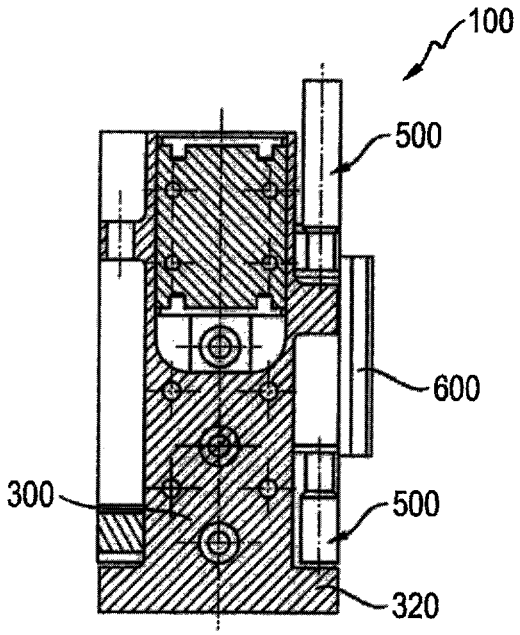
FIG. 2C is a sectional view of a linear drive device according to yet another embodiment.

FIG. 2C shows a sectional view of a linear drive device 100 according to yet another embodiment. This embodiment has the identical features of the embodiment of FIG. 2 B. The linear drive device 100 also includes the two damping elements 500 which are arranged on the first stop 402 and on the third stop 406. The first stroke end position and the second stroke end position are respectively changed by adjusting the damping elements 500 of the connecting element-side front side and the opposite front side of the linear drive device 100.

Figure 3A:
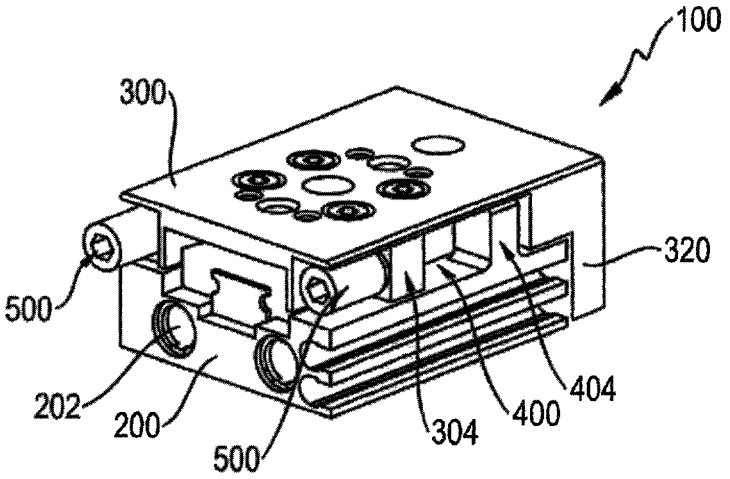
FIG. 3A is a perspective view of a linear drive device according to yet another embodiment.

FIG. 3A shows a perspective view of a linear drive device 100 according to yet another embodiment. This embodiment has a damping element 500 on the first stop 402 (not shown) and on the second counterstop 304. Consequently, the first stroke end position and the second stroke end position are determined by the damping elements 500 on the first stop 402 and on the second counterstop 304. The adjustment of the two stroke end positions done by adjusting the respective damping element 500, wherein the adjustment takes place exclusively from the front side of the linear drive device 100 opposite from the connecting element 320. Here, the damping element 500, which is arranged on the second counterstop 304, understood as a moving or moving damping element 500, since the same is arranged on a stop connected to the guide unit 300. A repeated description of identical features of the preceding figures will be omitted.

Figure 3B:
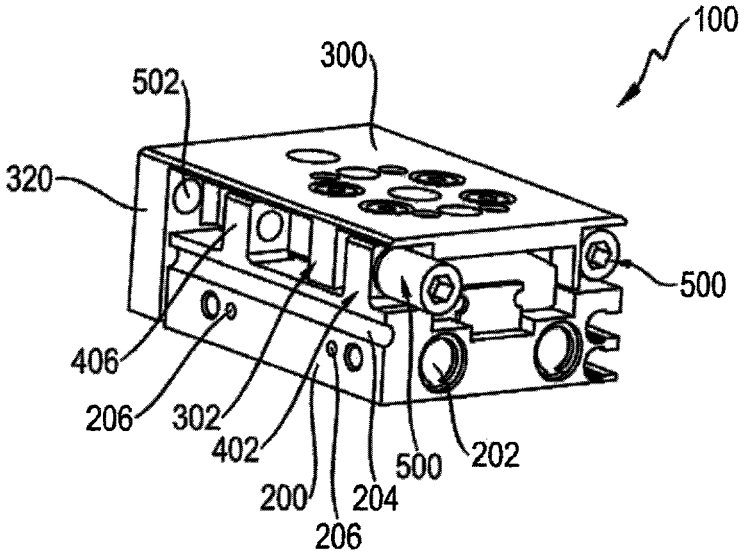
FIG. 3B is a perspective view of a linear drive device according to yet another embodiment.

FIG. 3B shows a perspective view of a linear drive device 100 according to yet another embodiment. The embodiment has identical features to FIG. 3A. The first stroke end position and the second stroke end position are determined by damping elements 500 on the first stop 402 and on the second counterstop 304 (not shown). Accordingly, the adjustment of the two stroke end positions takes place exclusively from the front side of the linear drive device 100 opposite the connecting element 320. In addition, the linear drive device 100 includes the third stop 406, which is not used for setting a stroke end position and thus also carries no damping element 500. In principle, however, the third stop 406 would be suitable for receiving a damping element 500 and serving as a stop for limiting a stroke end position. This could, for example, be adjusted at a later date if the need so requires. In this case, the adjustment of the supplemental damping element would take place through the opening 502 in the connection element 320. Laterally of the housing element 200 there is a groove 204 and two adjacent threads 206. Both the groove 204 and the threads 206 may be used to secure a sensor strip 600.

Figure 3C:
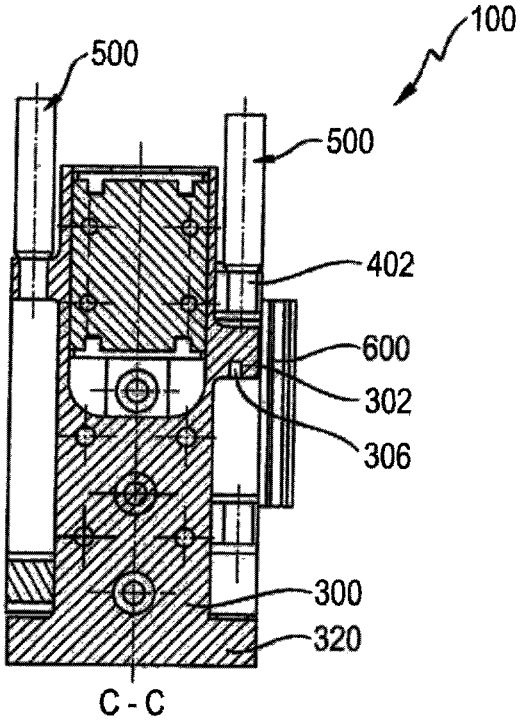
FIG. 3C is a sectional view of a linear drive device according to yet another embodiment.

FIG. 3C shows a sectional view of a linear drive device 100 according to yet another embodiment. The embodiment has identical features to FIGS. 3A and 3B. The first stroke end position and the second stroke end position are determined by damping elements 500 on the first stop 402 and on the second counterstop 304. The adjustment of the two stroke end positions is carried out from the front side of the linear drive device 100 opposite to the connecting device 320. In addition, the linear drive device 100 has a laterally arranged sensor strip 600, which can be used with the aid of sensor elements for determining the position of the guide unit 300. The magnetic element 306 cooperates with the sensor elements, is fully integrated into the first counterstop 302 and thus protected against external influences and damage.

Figure 4:
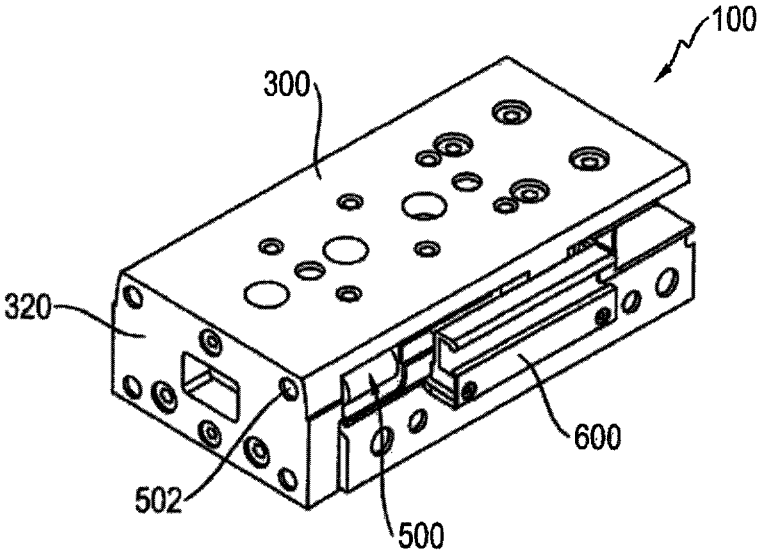
FIG. 4 is a perspective view of a linear drive device according to yet another embodiment.

FIG. 4 shows a perspective view of a linear drive device 100 according to yet another embodiment. This embodiment has a damping element 500 on the third stop 406. At the first stop 402 is no damping element. Consequently, the first stroke end position is adjustable by the damping element 500 and the third stop 406. The connecting element 320 in this case comprises two openings 502 in order to ensure access to the damping element 500. A repeated description of identical features of the preceding figures will be omitted.

Figure 5:
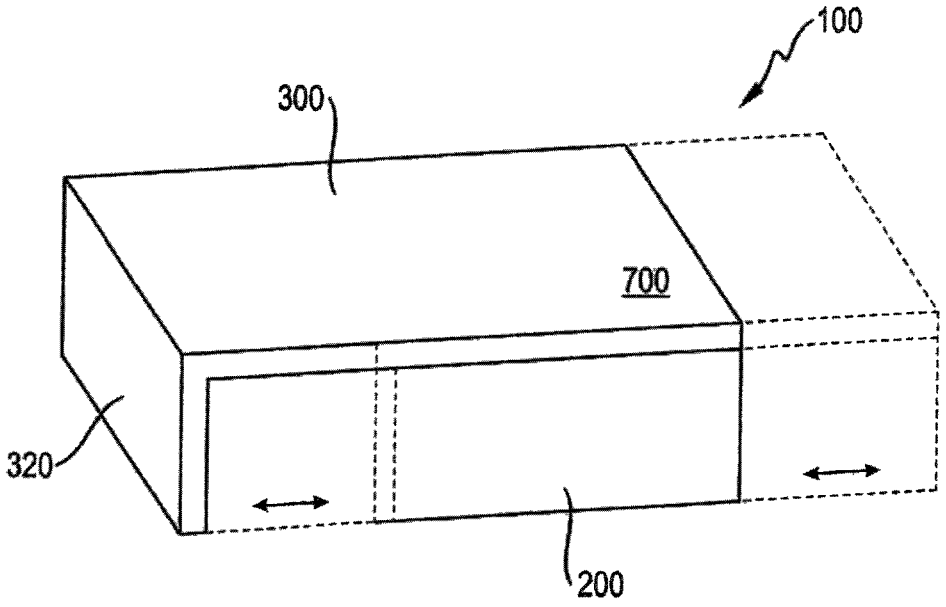
FIG. 5 is a perspective schematic representation of a linear drive device according to an embodiment.

FIG. 5 shows a perspective basic illustration of a linear drive device 100 according to one embodiment. The housing element 200 and the guide unit 300 define a construction space 700 by the first stroke end position and the second stroke end position. The space 700 provides the greatest possible spatial extent, which can be occupied by the linear drive device 100 through the two stroke end positions in operation. Both the stroke limiting device 400 (not shown) and the magnetic element 306 (not shown) are arranged within this construction space 700, whereby the entire linear drive device 100 is realized as a very compact and space-saving device.

Figure 6:
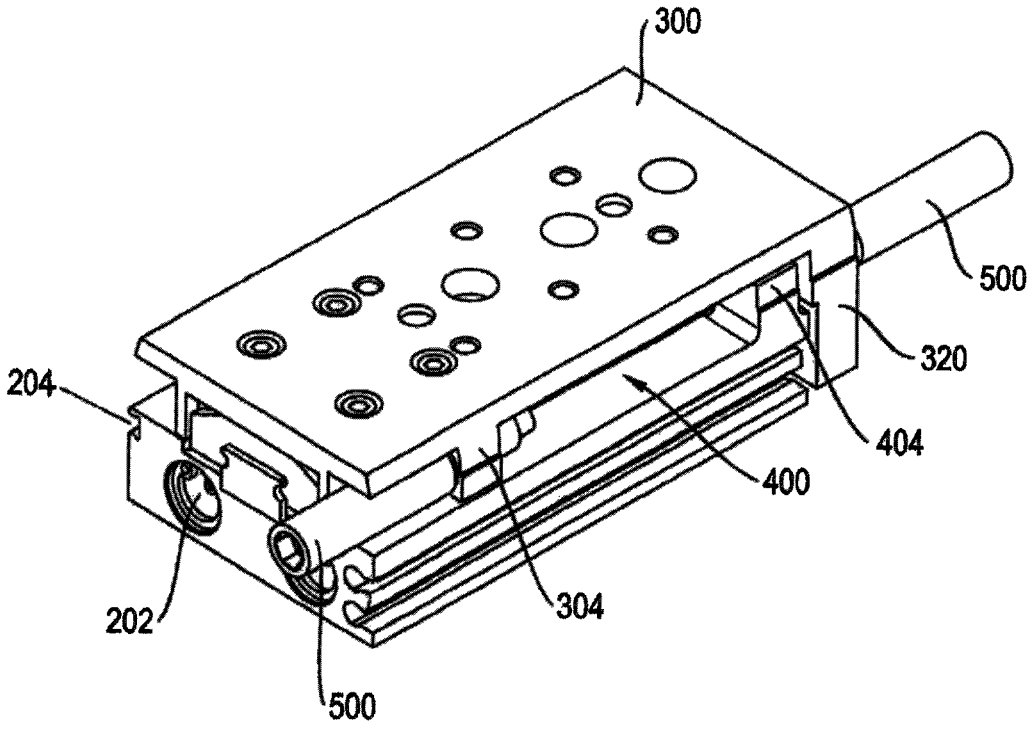
FIG. 6 is a perspective view of a linear drive device according to an additional embodiment.

FIG. 6 shows a perspective view of a linear drive device 100 according to an additional embodiment. A damping element 500 is arranged as a moving damping element 500 on the second counterstop 304 and is designed to cooperate with the second stop 404 for limiting the second stroke end position. An additional damping element 500 is arranged on the front side of the connecting element 320. Here, this damping element 500 is designed to cooperate with the second stop 404 for limiting the first stroke end position. A repeated description of identical features of the preceding figures will be omitted.

The invention claimed is:

1. Linear drive device, comprising:

a housing element in which at least one drivable actuating element is arranged, a guide unit which is coupled for movement with the actuating element and is guided linearly movable relative to the housing element between two stroke end positions, a stroke limiting device, by means of which a first stroke end position and a second stroke end position of the guide unit are adjustable, wherein the stroke limiting device comprises a first stop and a first counterstop for setting a limit of the first stroke end position and a second stop and a second counterstop for setting a first limit of the second stroke end position, wherein the stroke limiting device has a third stop which is adapted to set a second limit of the second stroke end position with the first counterstop, wherein the first counterstop is arranged between the first stop and the third stop.

2. Linear drive device according to claim 1, wherein at least the first stop, the second stop and the third stop are fixedly connected with the housing element.

3. Linear drive device according to claim 1, wherein at least the first counterstop or the second counterstop is adapted for arranging a damping element.

4. Linear drive device according to claim 1, wherein the first counterstop and the second counterstop are fixedly connected with the guide unit.

5. Linear drive device according to claim 1, wherein at least the first stop, the second stop and the third stop are adapted each for arranging a damping element.

6. Linear drive device according to claim 1, wherein the guide unit and the actuating element are connected via a connecting element.

7. Linear drive device according to claim 6, wherein the connecting element is arranged front side on the linear drive device.

8. Linear drive device according to claim 6, wherein the connecting element is designed as a yoke plate.

9. Linear drive device according to claim 6, wherein the connecting element and the guide unit is formed as an integral component.

10. Linear drive device according to claim 6, wherein the connecting element comprises at least one opening for adjusting a damping element.

11. Linear drive device according to claim 6, wherein the connecting element is adapted for arranging a damping element.

12. Linear drive device according to claim 1, wherein the first counterstop is adapted to support a magnetic element.

13. Linear drive device according to claim 1, wherein the housing element comprises at least one groove for receiving a sensor strip.

14. Linear drive device according to claim 1, wherein the linear drive device has a sensor strip which has sensor elements for detecting at least the first stroke end position and the second stroke end position of the guide unit.

15. Linear drive device according to claim 1, wherein the housing element and the guide unit define a construction space through the first stroke end position and the second stroke end position, wherein the stroke limiting device is arranged in its entirety within the construction space.

16. Linear drive device according to claim 1, wherein at least the first stop, the second stop and the third stop are fixedly connected with the housing element.

17. Linear drive device according to claim 1, wherein at least the first counterstop or the second counterstop is adapted for arranging a damping element.

18. Linear drive device according to claim 2, wherein at least the first counterstop or the second counterstop is adapted for arranging a damping element.

19. Linear drive device according to claim 1, wherein the first counterstop and the second counterstop are fixedly connected with the guide unit.

* * * * *